US007218287B2

(12) United States Patent
Hung et al.

(10) Patent No.: US 7,218,287 B2
(45) Date of Patent: May 15, 2007

(54) DIPOLE ANTENNA

(75) Inventors: Chen-Ta Hung, Santa Clara, CA (US); Wen-Fong Su, Tu-Chen (TW); Lung-Sheng Tai, Tu-Chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/173,715

(22) Filed: Jun. 30, 2005

(65) Prior Publication Data

US 2006/0125697 A1 Jun. 15, 2006

(30) Foreign Application Priority Data

Dec. 10, 2004 (CN) ..... 2004 1 0066198

(51) Int. Cl.
*H01Q 9/28* (2006.01)

(52) U.S. Cl. ..... 343/795; 343/700 MS

(58) Field of Classification Search ..... 343/700 MS, 343/702, 795

See application file for complete search history.

(56) References Cited

U.S. PATENT DOCUMENTS 5,293,175 A * 3/1994 Hemmie et al. ..... 343/795
6,621,464 B1 * 9/2003 Fang et al. ..... 343/795
6,791,506 B2 * 9/2004 Suganthan et al. ..... 343/795
6,906,678 B2 * 6/2005 Chen ..... 343/795
6,961,028 B2 * 11/2005 Joy et al. ..... 343/895
7,042,415 B2 * 5/2006 Cheng ..... 343/795
2003/0231139 A1 * 12/2003 Tai et al. ..... 343/795
2004/0222936 A1 * 11/2004 Hung et al. ..... 343/795
2005/0153756 A1 * 7/2005 Sato et al. ..... 455/575.7

* cited by examiner

*Primary Examiner*—Tan Ho
(74) *Attorney, Agent, or Firm*—Wei Te Chung

(57) ABSTRACT

A dipole antenna (1) includes a first radiating trace (21) and a first grounding trace (31) respectively extending in substantially opposite directions, a second radiating trace (22) extending from an end of the first radiating trace in a direction which substantially perpendicular to the first radiating trace, and a second grounding trace (32) extending from an end of the first grounding trace in an opposite direction to the second radiating trace. The total length of the first and second radiating traces are ¼ operating wavelength of the dipole antenna.

10 Claims, 8 Drawing Sheets

DIPOLE ANTENNA

BACKGROUND OF THE INVENTION

1. Field of the Invention

The present invention relates to an antenna, and in particular to a dipole antenna employed in a laptop computer, a portable electronic device or other electronic devices.

2. Description of the Prior Art or Related Art

When wireless communication technologies, such as WLAN standards, are applied in electronic devices such as notebook computers or portable game devices, antennas become indispensable components to these devices for wireless access. As a basic antenna structure, a dipole antenna is a popular choice for the RF engineer because it has features of low cost and is easy to design and test. A traditional dipole antenna usually includes a pair of linear dipole elements extending in opposite directions, which can get polarization in a single direction. But if the traditional dipole antenna is assembled in a Liquid Crystal Display (LCD) of a notebook or other portable devices, the receiving and transmitting capability of the dipole antenna could be better when the LCD is in a predetermined position (such as parallel to the ground), but also could be worse when the LCD is in a different position (such as perpendicular to the ground). So the open angle of the LCD relative to a panel of the notebook computer will affect performance of the dipole antenna or other single-liner polarized antenna assembled in the LCD.

U.S. Pat. Publication No. 20040012534 discloses a dual-band printed dipole antenna. The dipole antenna comprises a pair of dipole elements (212, 222) operated in a lower frequency and disposed on a substrate. The dipole antenna is formed into inverted-V shape to for impendence matching purpose. However vertical and horizontal polarization improvements are not considered simultaneously in this design.

Hence, an improved dipole antenna is desired to overcome the above-mentioned disadvantages of the prior and related arts.

BRIEF SUMMARY OF THE INVENTION

A primary object of the present invention is to provide a dipole antenna having balanced polarization in both vertical direction and horizontal directions.

A dipole antenna in accordance with the present invention includes a first radiating trace and a first grounding trace respectively extending in substantially opposite directions, a second radiating trace extending from an end of the first radiating trace in a direction which substantially perpendicular to the first radiating trace, and a second grounding trace extending from an end of the first grounding trace in an opposite direction to the second radiating trace. The total length of the first and second radiating traces are ¼ operating wavelength of the dipole antenna.

Still another objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
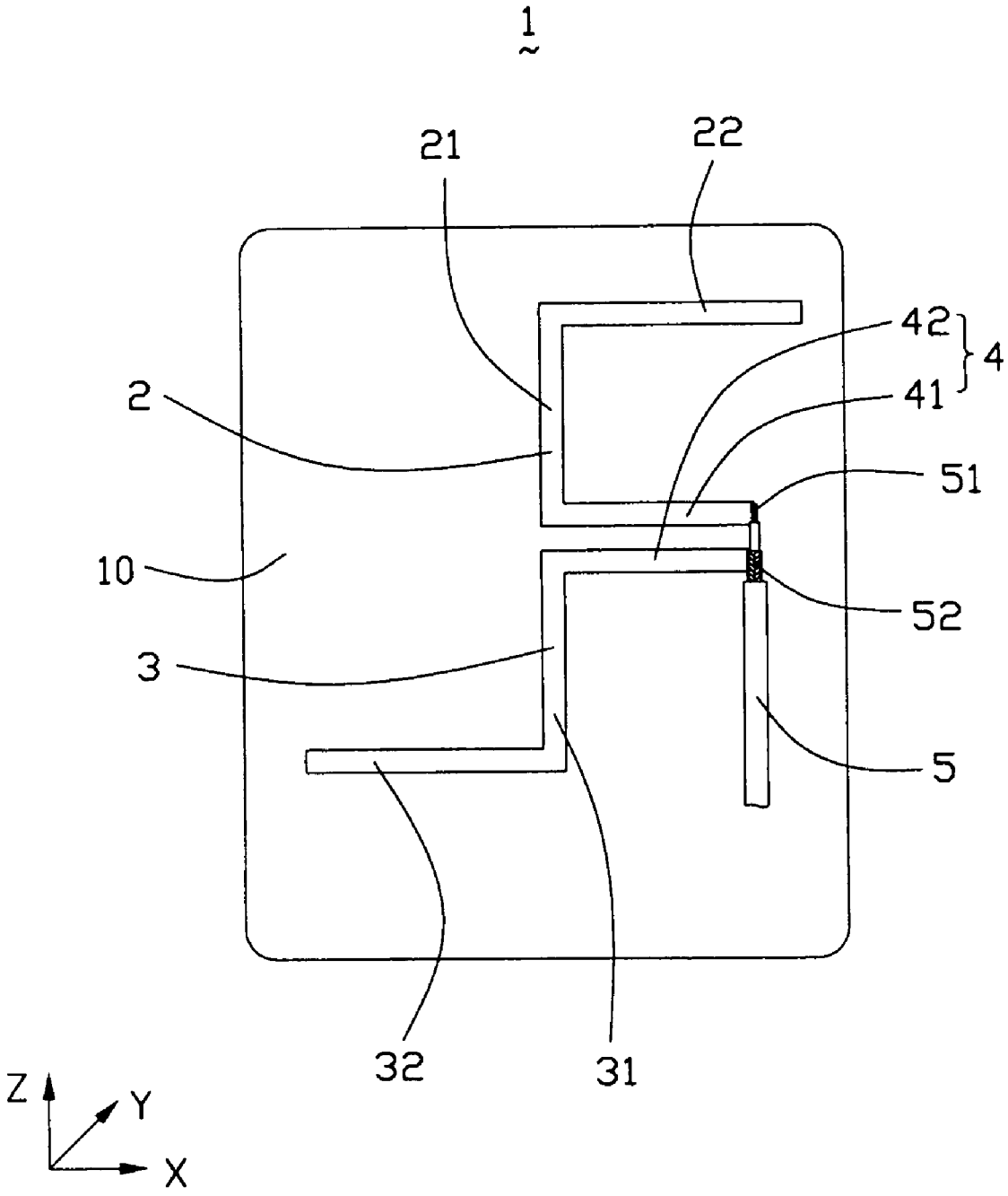
FIG. 1 is a top plan view of a dipole antenna in accordance with the present invention, which is disposed on a substrate.

Referring to FIG. 1, a dipole antenna 1 in accordance with the present invention comprises a substrate 10, a radiating dipole element 2 and a grounding dipole element 3, impendence matching member 4 and a coaxial cable 5.

With reference to the definition of directions X, Y, Z in FIG. 1, the radiating dipole element 2 is L-shaped and includes a first radiating trace 21 that extends in a vertical direction parallel to direction Z and a second radiating trace 22 perpendicularly extending from an end of the first radiating trace 21 and parallel to direction X. The first and second radiating traces 21, 22 are also substantially perpendicular to each other. The grounding dipole element 3 has the same dimension as that of the radiating dipole element 2. The grounding dipole element 3 includes a first grounding trace 31 and a second grounding trace 32 extending from an end of the first grounding trace 31. The first and second grounding traces 31, 32 are substantially perpendicular to each other. The first grounding trace 31 extends oppositely to the first radiating trace 21 and is aligned in a line with the first radiating trace 21. The second grounding trace 32 is parallel to the second radiating trace 22 but extends in an opposite direction.

The impendence matching member 4 includes a pair of parallel matching traces 41, 42 perpendicularly extending form ends of the first radiating trace 21 and the first grounding trace 31, respectively. The matching traces 41, 42 are substantially parallel to each other and have the same dimension. The distance between the matching traces 41, 42 and the length of the matching traces 41, 42 provide convenient adjustment for the impendence matching between the dipole antenna 1 and the coaxial cable 5. The coaxial cable 5 includes an inner conductor 51 connecting with an end of one matching trace 41 and an outer conductor 52 connecting with an end of the other matching trace 42.

Figure 2:
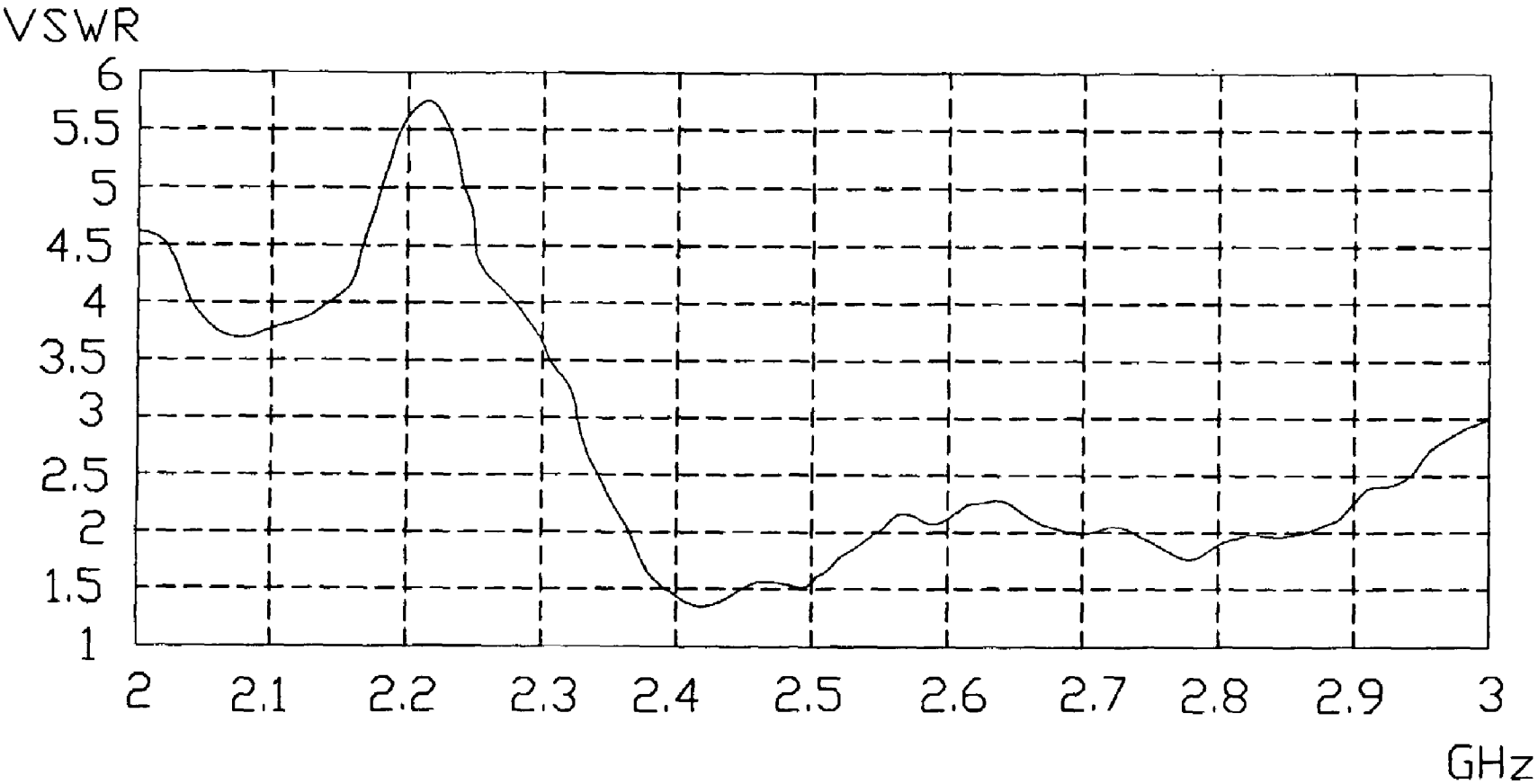
FIG. 2 is a test chart recording for the dipole antenna of FIG. 1, showing Voltage Standing Wave Ratio (VSWR) as a function of frequency.
Figure 3:
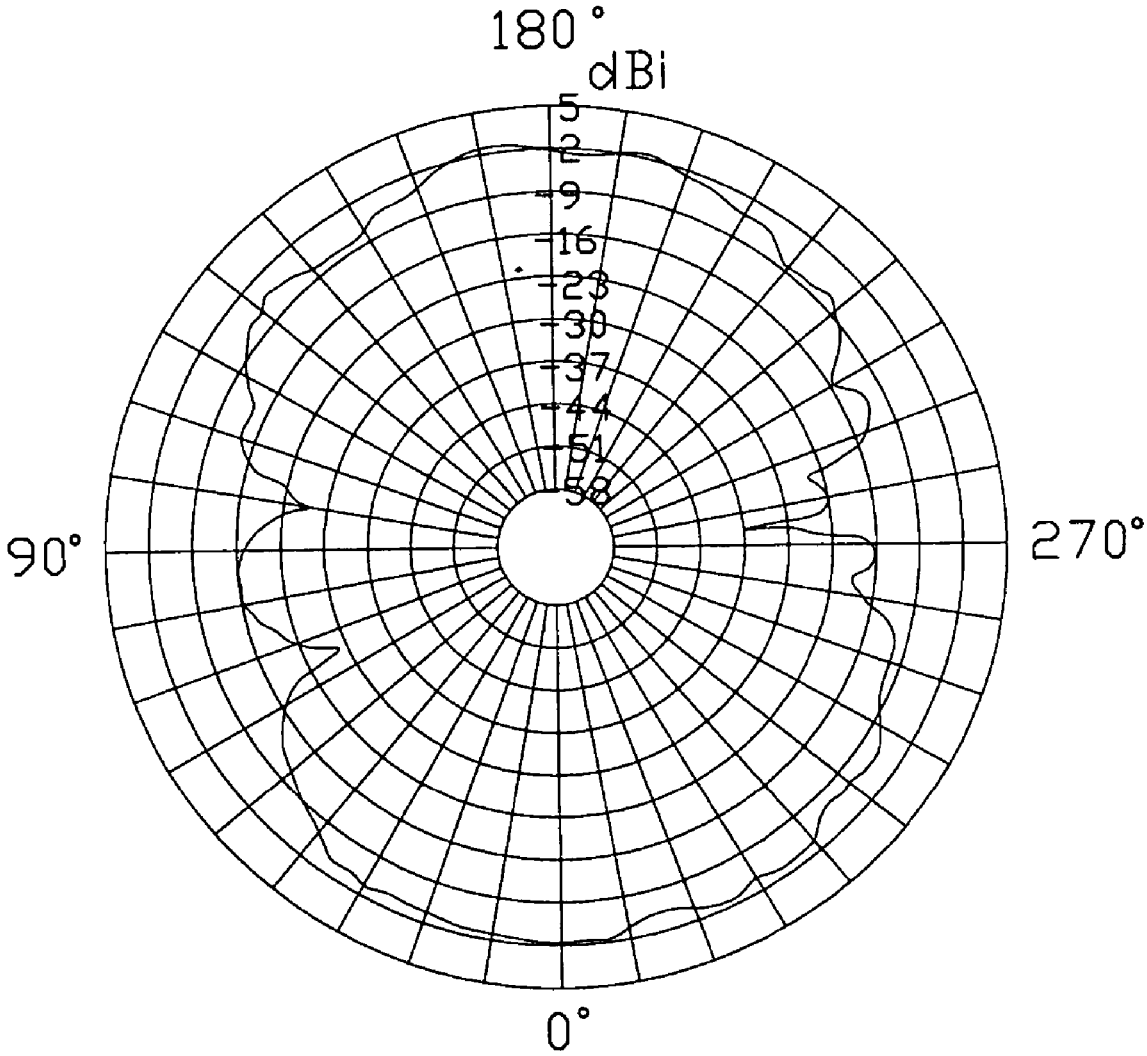
FIG. 3 is a recording of a horizontally polarized principle plane radiation pattern in X-Y plane of the dipole antenna of FIG. 1 operating at a frequency of 2.45 GHz.
Figure 4:
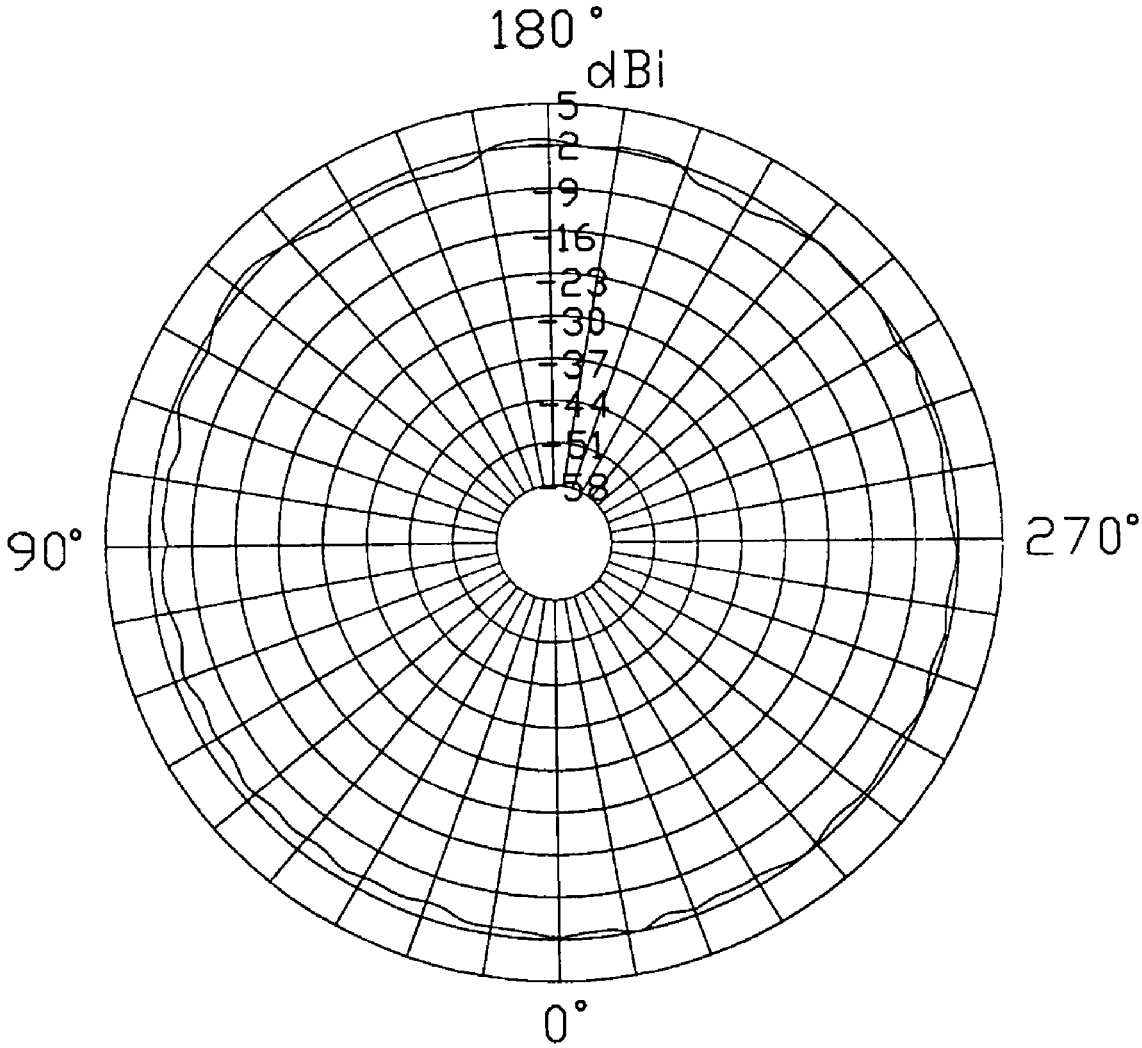
FIG. 4 is a recording of a vertically polarized principle plane radiation pattern in X-Y plane of the dipole antenna of FIG. 1 operating at a frequency of 2.45 GHz.
Figure 5:
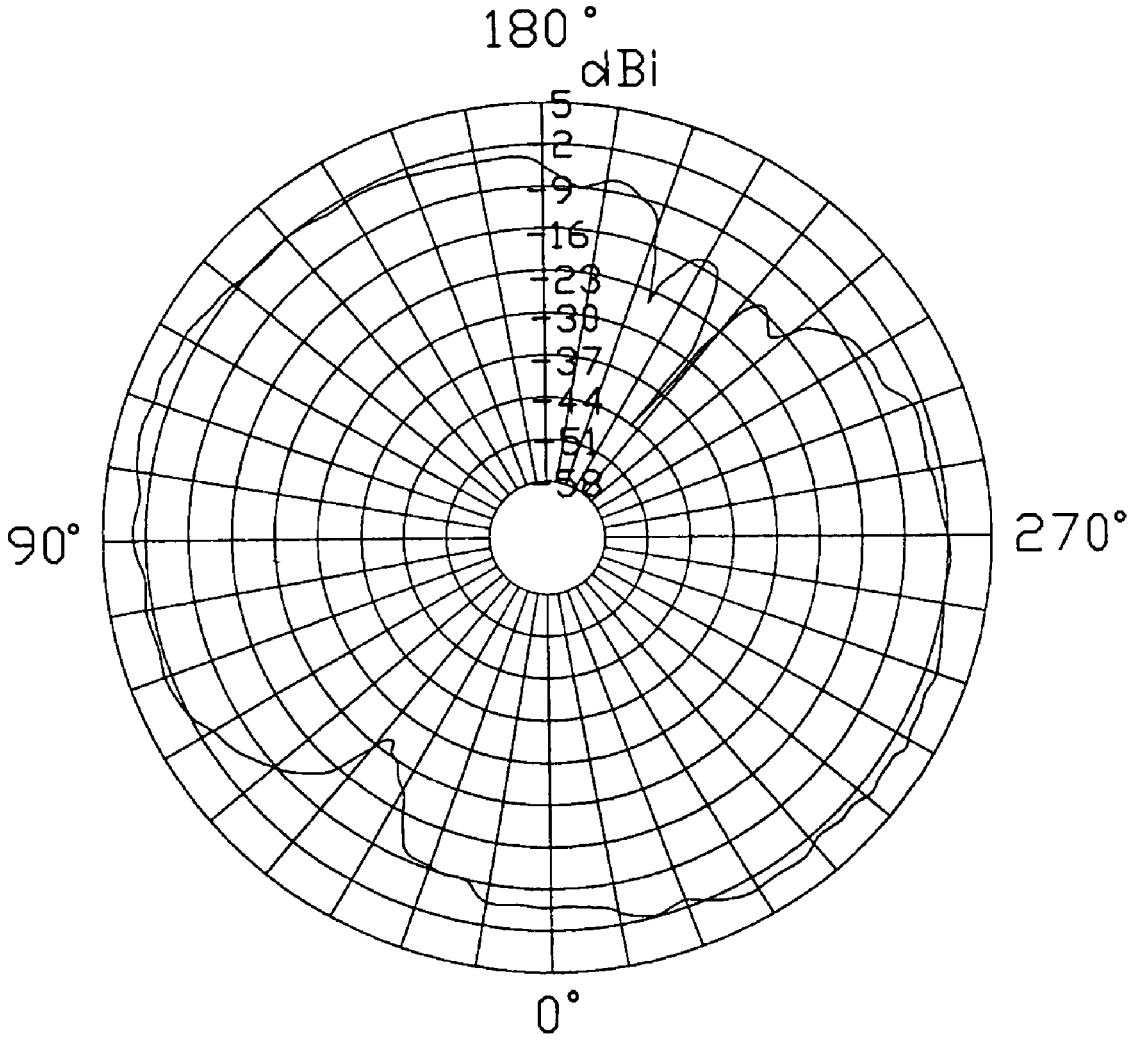
FIG. 5 is a recording of a horizontally polarized principle plane radiation pattern in X-Z plane of the dipole antenna of FIG. 1 operating at a frequency of 2.45 GHz.
Figure 6:
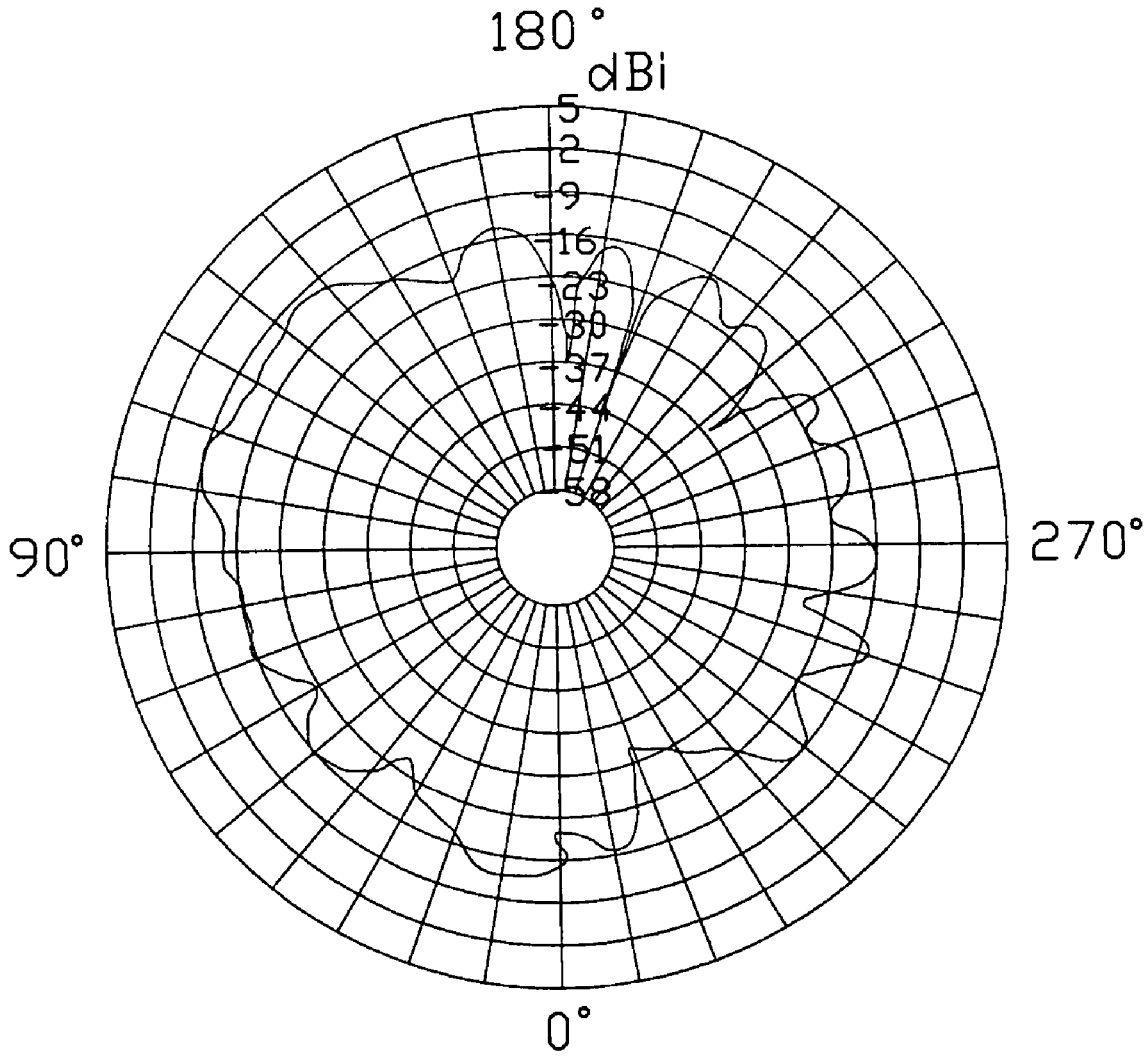
FIG. 6 is a recording of a vertically polarized principle plane radiation pattern in X-Z plane of the dipole antenna of FIG. 1 operating at a frequency of 2.45 GHz.
Figure 7:
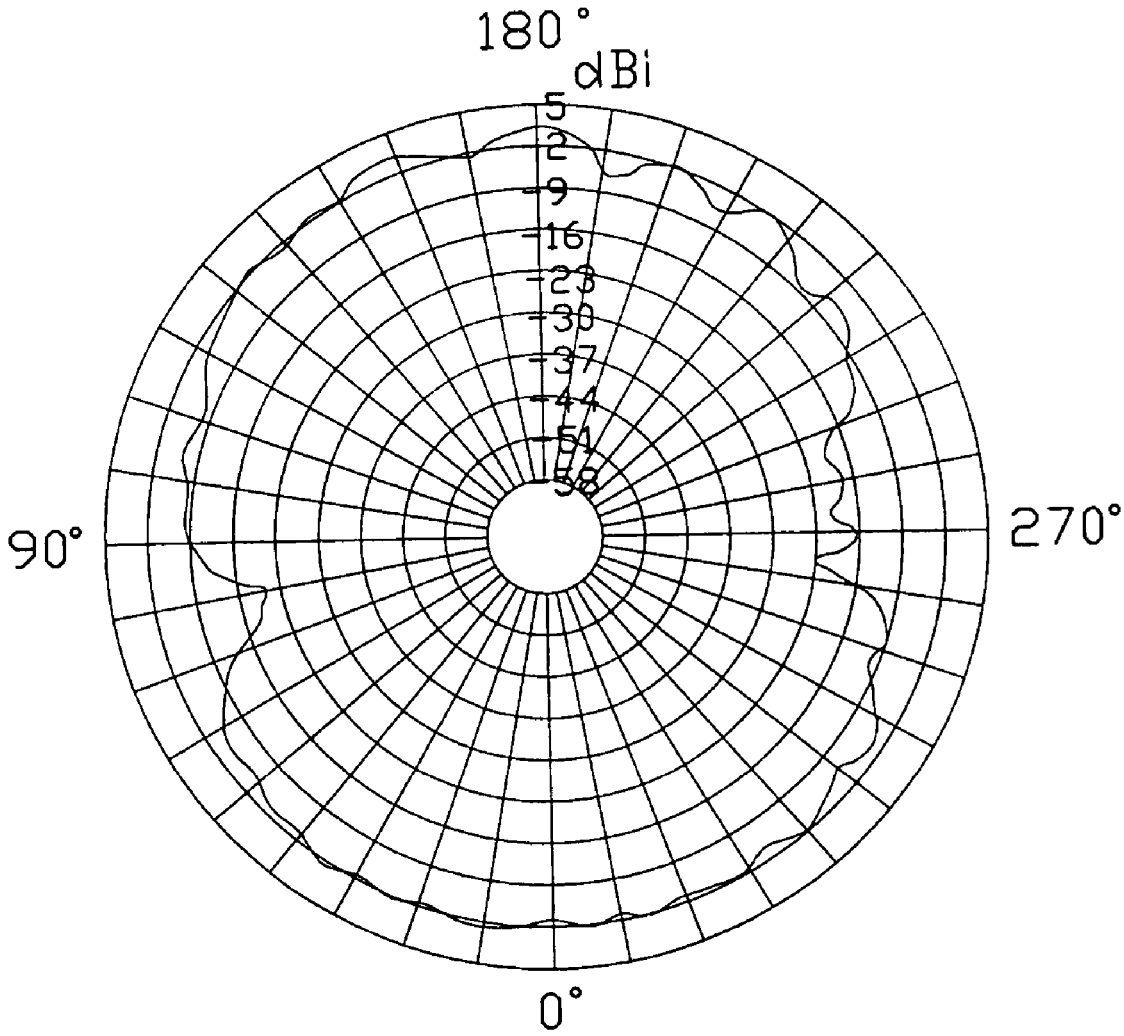
FIG. 7 is a recording of a horizontally polarized principle plane radiation pattern in Y-Z plane of the dipole antenna of FIG. 1 operating at a frequency of 2.45 GHz.
Figure 8:
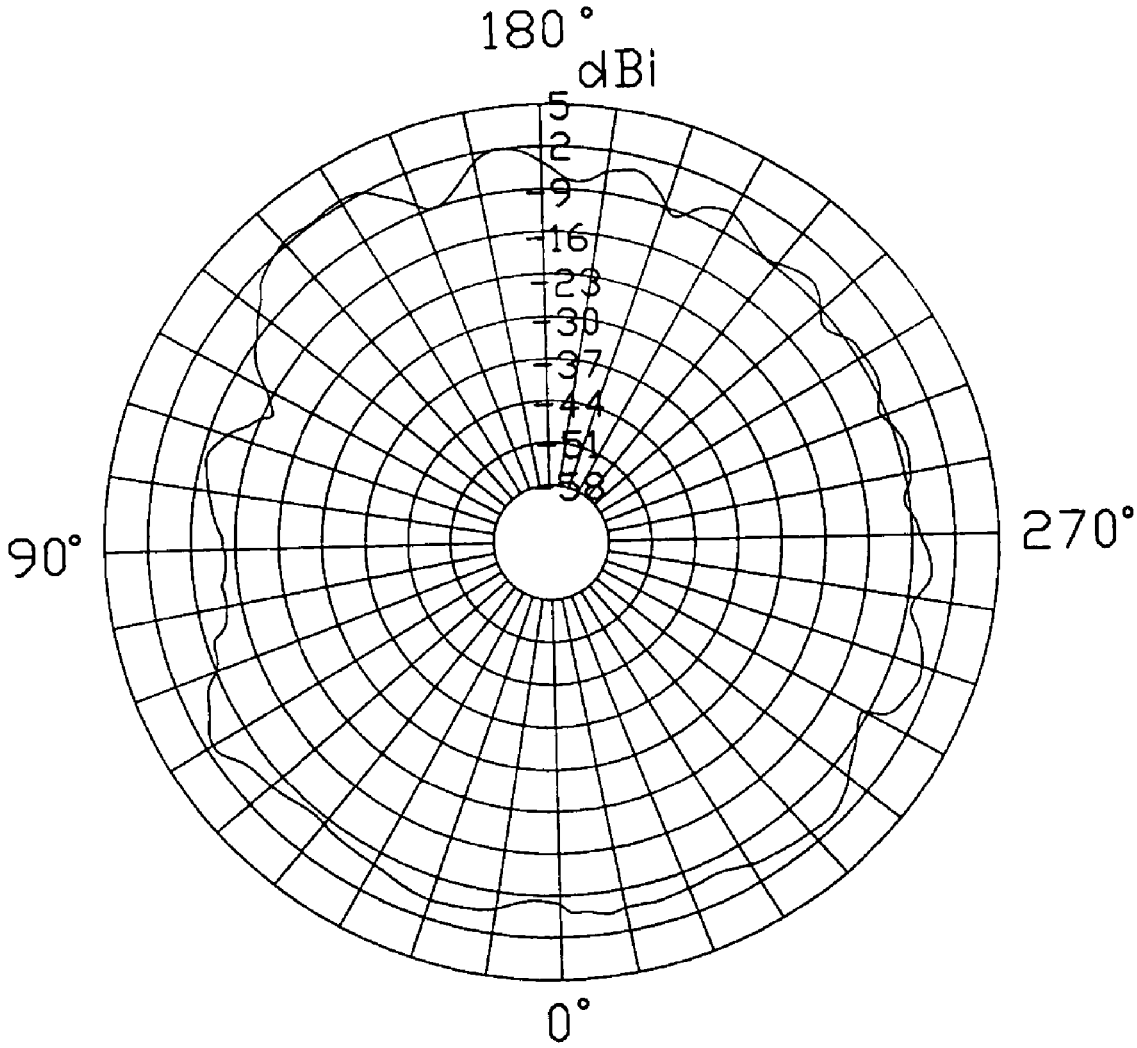
FIG. 8 is a recording of a vertically polarized principle plane radiation pattern in Y-Z plane of the dipole antenna of FIG. 1 operating at a frequency of 2.45 GHz.

The first radiating trace 21 and the first grounding trace 31 can be treated as a first pair of dipole branches, which provide horizontal polarization improvement on XY, YZ and XZ planes in FIG. 1. The second radiating trace 22 and the second grounding trace 32 can be treated as a second pair of dipole branches, which provide perpendicular polarization improvement on each plane described above. In this embodiment, the length of the first and second radiating traces 21, 22 and the first and second grounding trace 31, 32 are both selected form a scope of 1/12 to 1/6 of operating wavelength of the dipole antenna. The total length of the first and second radiating traces 22 are 1/4 of operating wavelength, so do the first and second grounding traces 32. In such a condition, a balanced polarization on each plane is achieved, which are directly shown on FIG. 3 to FIG. 8 with no obvious radiating blind area. The impendence-matching problem will be solved by adjusting the length of the matching traces 41, 42 and the distance therebetween. The dipole elements 2, 3 and the matching traces 41, 42 are all disposed on the substrate 10, which achieves an impact design and need not to provide a complex impendence member. FIG. 2 shows a test chart recording of Voltage Standing Wave Ratio (VSWR) of the dipole antenna 1 as a function of frequency. Note that VSWR drops below the desirable maximum value "2" in the 2.4–2.5 GHz frequency band, indicating acceptably efficient operation in this frequency band, which covers more than the total bandwidth of 802.1 lb standard.

Since the dipole antenna 1 has a balanced polarization, when it is assembled in a display of a notebook or other like portable device, the dipole antenna 1 can provide desired transmitting and receiving performance regardless what angle of the display (relative to a panel of the notebook) is. Assembled with such balanced polarization antenna, a user may enjoy good wireless communication and need not to adjust the angle of the antenna, the position of his portable device or open angle of the display.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dipole antenna comprising:

a first radiating trace extending in a first direction;

a first grounding trace aligned with the first radiating trace;

a pair of parallel matching traces respectively connecting with adjacent one ends of the first radiating trace and the first grounding trace;

a second radiating trace extending in a second direction from the other end of the first radiating trace and parallel to the matching traces;

a second grounding trace extending from the other end of the first grounding trace opposite to and parallel to the second radiating trace; and a coaxial cable;

wherein the total length of the first and second radiating traces are 1/4 operating wavelength of the dipole antenna.

2. The dipole antenna as claimed in claim 1, further comprising a substrate on which the first and second radiating traces and the first and second grounding traces are all disposed.

3. A dipole antenna comprising:

a pair of matching traces parallel to each other with a predetermined distance;

a first radiating trace and a first grounding trace oppositely extending from ends of the matching traces and aligned in a line;

a second radiating trace extending from an end of the first radiating trace in a first direction;

a second grounding trace extending from an end of the second radiating trace in a second direction which is opposite to the first direction;

wherein the second radiating trace is parallel to second grounding trace; wherein the first radiating trace is perpendicular to the second radiating trace.

4. The dipole antenna as claimed in claim 3, wherein one patch trace, the first radiating trace and the second radiating trace commonly constitute a U-like configuration, while the other patch trace, the first grounding trace and the second grounding trace commonly constitute a Z-like configuration.

5. The dipole antenna as claimed in claim 4, further including a cable having outer and inner conductors respectively connected two free ends of said pair of patch traces.

6. The dipole antenna as claimed in claim 3, further comprising a substrate where the first and second radiating traces, the first and second grounding traces and the matching traces are disposed thereon.

7. An antenna comprising:

a substrate;

a pair of dipole elements both disposed on the substrate and substantially having the same length; said pair of dipole elements comprising a first pair of dipole branches providing horizontal polarization, a second dipole branches providing vertical polarization; and a pair of matching traces providing impendence match adjustment between the dipole antenna and a coaxial cable.

8. The antenna as claimed in claim 7, wherein the pair of matching traces are substantially perpendicular to the pair of first dipole branches and parallel to the pair of second dipole branches.

9. The antenna as claimed in claim 8, wherein the pair of matching traces are parallel to each other.

10. The antenna as claimed in claim 7, wherein the first dipole branches are aligned with each other while the pair of second dipole branches are parallel to each other.

* * * * *